US006358114B1

(12) United States Patent
Walker et al.

(10) Patent No.: US 6,358,114 B1
(45) **Date of Patent: *Mar. 19, 2002**

(54) METHOD AND APPARATUS FOR OPTICAL POLISHING

(75) Inventors: David Douglas Walker; Richard George Bingham; Sug-Whan Kim, all of Hendon; Keith Ernest Puttick, Guildford, all of (GB)

(73) Assignee: Optical Generics Limited, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/983,413

(22) PCT Filed: Jun. 17, 1996

(86) PCT No.: PCT/GB96/01459

§ 371 Date: Jun. 12, 1998

§ 102(e) Date: Jun. 12, 1998

(87) PCT Pub. No.: WO97/00155

PCT Pub. Date: Jan. 3, 1997

(30) Foreign Application Priority Data

Jun. 16, 1995 (GB) ..... 9512262

(51) Int. Cl.[7] ..... B24B 49/00; B24B 1/00

(52) U.S. Cl. ..... 451/5; 451/8; 451/19; 451/24; 451/41; 451/59; 451/158; 451/159

(58) Field of Search ..... 451/5, 8, 10, 11, 451/19, 24, 41, 59, 158, 159

(56) References Cited

U.S. PATENT DOCUMENTS 4,128,968 A 12/1978 Jones
4,627,195 A * 12/1986 Greenlief ..... 451/270
4,850,152 A * 7/1989 Heynacher et al. ..... 451/5

(List continued on next page.)

FOREIGN PATENT DOCUMENTS

EP 326811 A2 4/1990
EP 362811 4/1990
EP 653270 5/1995

(List continued on next page.)

OTHER PUBLICATIONS

"The Production of Highly Aspheric Secondary mirrors using Active Laps" by D.D. Walker, ESO Conference and Workshop Proceeedings No. 42, pp. 215–218, ESO Garching, Apr. 27–30, 1992.

(List continued on next page.)

*Primary Examiner*—M. Rachuba
(74) *Attorney, Agent, or Firm*—Ohlandt, Greeley, Ruggiero & Perle, L.L.P.

(57) ABSTRACT

A lapping tool for localized optical polishing of a workpiece, the tool having a flexible working surface and being characterized by means for selectively varying the pressure applied, in use, on the workpiece by different regions of the tool working surface whereby to vary the effective area of contact with the workpiece. A method of optical polishing and optical workpiece using a lapping tool whose maximum working surface area is substantially smaller than the workpiece, comprising determining the path to be travelled by the tool across the workpiece, and determining the pressure and effective area of contact of the tool on the workpiece, in order to achieve the next stage of polishing, and then driving the tool over that path while dynamically varying the said applied pressure and effective contact area. Apparatus for guiding a body, such as an optical polishing tool, over a generally flat structure, such as an optical workpiece, comprising a three-dimensional drive mechanism for the controlled movement of the body across the surface of the structure, and a pivoted linkage linking the drive mechansim to the body such as to constrain the body to pivotal motion about a virtual pivot point which is fixed relative to the drive mechanism and is located at the interace between the body and the workpiece.

28 Claims, 4 Drawing Sheets

U.S. PATENT DOCUMENTS

| | | | | |
|---|---|---|---|---|
| 4,958,463 | A | | 9/1990 | Hess et al. |
| 4,974,368 | A | * | 12/1990 | Miyamoto et al. ..... 451/159 |
| 5,138,798 | A | * | 8/1992 | Volat ..... 451/42 |
| 5,157,878 | A | | 10/1992 | Hiyoshi et al. |
| 5,255,474 | A | | 10/1993 | Gawa et al. |
| 5,347,763 | A | * | 9/1994 | Miyamoto et al. ..... 451/241 |
| 5,525,096 | A | * | 6/1996 | Mayahara et al. ..... 451/292 |
| 5,895,311 | A | * | 4/1999 | Shiotani et al. ..... 451/5 |

FOREIGN PATENT DOCUMENTS

| | | |
|---|---|---|
| EP | 653270 A1 | 5/1995 |
| GB | 615649 | 1/1949 |
| GB | 947176 | 1/1964 |
| GB | 1319882 | 6/1973 |
| GB | 2050884 | 1/1981 |
| GB | 1599659 | 10/1981 |
| GB | 1602660 | 11/1981 |
| GB | 2163076 A | 2/1986 |
| GB | 2259662 A | 3/1993 |
| GB | 2270866 | 3/1994 |
| GB | 2259662 B | 12/1994 |

OTHER PUBLICATIONS

"Rapid Optical Fabrication With Computer–Controlled Optical Surfacing" by Jones R.A. et al., Optical Engineering, vol. 30, No. 12, Dec. 1, 1991, pp. 1962–1968, XP000240917.

* cited by examiner

METHOD AND APPARATUS FOR OPTICAL POLISHING

This invention relates primarily to the optical polishing, lapping or figuring of optical surfaces, and is particularly useful in the production of large mirrors which may be spherical or aspherical and may be of eccentric shape.

The well-established process which the invention enhances consists of grinding, polishing and figuring, with loose abrasive or abrasive particles in a softer matrix. A pad or lap is used to apply the abrasive to the workpiece. "Figuring" is continued polishing, applied differentially over the surface to produce very fine changes of surface height.

The "tool" is part of the machine. It carries the pad which applies the abrasive to the workpiece. The diameter of this pad is conventionally referred to as the diameter of the tool. The process is usually wet. After some polishing, the workpiece is cleaned and optically tested. The optical test identifies parts of the surface which, although polished, are erroneously proud of the desired profile. Further polishing is applied preferentially in the proud areas. This can be achieved typically by varying the pressure or speed of the polishing pad. Numerous attempts to reduce the errors may be necessary and the process is iterative.

For surfaces which are not spherical (parts of spheres), iterative figuring is a lengthy process. Mechanisation of the former hand-craft has been attempted with some success (see below), but has not provided a technique with the versatility of hand-craft. Large and small tools have different problems.

On the one hand, the best quality is achieved with large tools. They generally conform to the desired aspherical shape of the surface. However, those tools are built and rebuilt for particular workpieces and are often operated in an expensive research and development context with access to the engineers who designed them.

On the other hand, small tools may more accurately simulate hand-polishing and are versatile. Unfortunately, if they operated automatically, they tend to create residual defects which are difficult to remove with the same tool. For example, the edges of the tool may create many ridges or grooves which are narrower than the tool itself. They will be visible in the optical test but attempting to remove them with the same tool may create a fresh set of similar defects, slightly moved. Changing the tool introduces further problems. Removing tool-induced features by applying gradually less work in each pass, or by using feathered-out strokes of the tool, is very slow. These problems, whilst not invalidating the process, greatly prolong the series of iterations and the general complexity.

U.S. Pat. No. 4,128,968 (1978) described an automatic polishing machine in which the effect of the edge of a small tool is reduced by local sub-motion of the tool. When the small tool is dithered in position, the centre of the contact area is continuously polished but the edge of the area is less polished. The "removal profile" is specified as being circularly symmetrical. The tool has a pattern of motion which may be helical over the whole surface. The tool itself can rotate on a subsidiary axis which can be the local axis of the tool. Dithering is a method or pattern of operation of the whole tool which attempts to remove the errors it otherwise produces. It is outdated by software: the pattern of motion of the tool can be computed optimally to improve the particular work piece, rather than to produce an arbitrary circular removal profile, which is not necessarily what is required. Also, the dithering effect inevitably makes the locally polished area larger, which again is not necessarily required.

U.S. Pat. No. 5,157,878 (1992) describes a polishing tool consisting of a running tape pressed against the workpiece.

UK patent application 2 259 662 (1993) describes a machine applicable to complex aspherical spectacle lenses which resembles a multi-axis milling machine with an unspecified polishing head substituted for a cutting head.

The University of Arizona and University College London have described machines with a complex tool of a diameter approximately half or more the diameter of the workpiece. Essentially all the active area of the tool is available to contact with the workpiece at any instant. The tilt angle of the tool is defined by its contact with the workpiece. An example is published in ESO Conference and Workshop Proceedings No.42, pages 215–218, ESO Garching, Apr. 27–30 1992, "The Production of Highly Aspheric Secondary Mirrors Using Active Laps" by D. D. Walker et al.

The Zeiss company has described a machine with an elongated complex tool whose length is approximately half the diameter of the workpiece. As with the large tool described above, essentially all the active area of the tool is available to contact with the workpiece at any instant. The tilt angle of the tool is defined by its contact with the workpiece. In their Patent Application GB-A-2163076, the complex tool is substantially coextensive with the workpiece.

The diameter of the tool is typically less than 25 percent of the diameter of the workpiece.

The pressure distribution applied by the tool can be axially symmetrical.

The tool can be mounted on driven bearings which enable it to sweep over the workpiece in any desired pattern of motion at controllable speeds.

The tool can be mounted on a subsidiary motorised spindle which may be on an axis of symmetry of a tool. The tool may controllably rotate on this spindle as part of its polishing motion.

The workpiece may be mounted on a turntable which continuously rotates.

The tool can be activated to move over a fixed workpiece in a pattern which gives the same effective work as if the workpiece were rotating.

In order that the invention may be better understood, a number of embodiments will now be described, by way of example only, with reference to the accompanying drawings, in which.

Figure 1A:
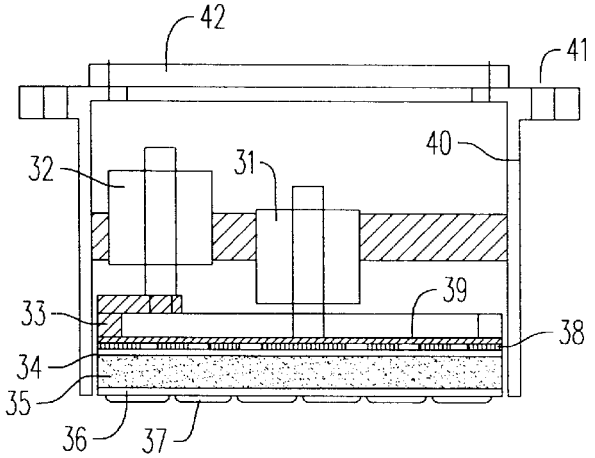
FIG. 1A is a schematic axial section through part of a lapping tool embodying the invention.
Figure 1B:
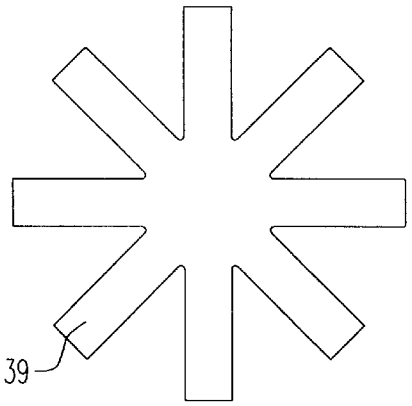
FIG. 1B is a plan view of a spring arranged transversely within the tool illustrated in FIG. 1A.
Figure 1C:
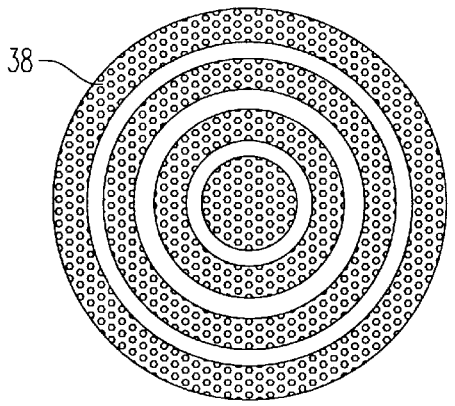
FIG. 1C is a plan view of a set of annular pressure rings within the tool of FIG. 1A.

An exemplification of the invention is illustrated in FIG. 1. The polishing action is provided by pads of pitch (37). The workpiece (not shown) is in contact with the lower side of the pitch pads.

The pads of pitch adhere to a thin membrane of stainless steel (36).

The membrane is supported by and cemented to a compressible layer (35) of neoprene, rubber or plastics or a foam of those materials. On the upper side of the compressible layer, a further stainless steel membrane (34) is cemented. Pressure is applied to this upper membrane by a set of annular pressure rings (38). The annular pressure rings (38) are spot welded to a flat eight-armed spring (39).

A principal actuator is shown in outline (31) and described in detail here. It is a motorised screw drive in the form of a commercially available stepper motor with a hollow threaded rotor driving a vertical plunger. The plunger itself is extended with a compression spring attached to the acting (lower) end of the plunger. A standard commercially available load cell is fitted within the compression spring. The principal actuator enables the pressure in the centre of the working area of the tool to be increased as the actuator is operated vertically downwards.

A stiffening ring (34) is brazed onto the upper side of the eight-armed spring (39). The edge actuator (32) shown is one of three angularly-spaced edge-actuators which are constructed in a similar way to that described above for the principal actuator (31). They are equi-spaced around the periphery and push or pull onto the stiffening ring (33). They also incorporate load cells and serve to control both the tilt of the lower pitch face and the overall pressure and shape, in conjunction with the principal actuator (31).

The tool is enclosed in a cast aluminium housing (40) with an access lid (42) which in practice carries electrical connectors and wiring (not shown). The housing (40) has a supporting flange or lugs (41).

The stepper motors are computer-driven by means of a standard integrated-circuit stepper-motor controller with a power amplifier stage. The force values indicated by the load cells are available to the computer by means of standard analogue-to-digital converters.

The tool is mounted by means of the flange or lugs (41) onto two coordinate cross-slides driven by stepper motors and rack and pinion gearing. This drive system can also incorporate means for spinning the tool and if so also incorporates slip rings for the electrical supplies to the tool. The total downward force of the tool onto the workpiece is in the range 8 to 50 grams per square centimeter of the working area.

Active control of the motion of the tool includes control of the pressure distribution exerted by the tool on the workpiece e.g. mirror, and of the distribution of speed of the moving tool in relation to the mirror (stroke, rotation). As disclosed more fully in our paper mentioned above entitled "The production of highly aspheric secondary mirrors using active laps", the control uses feedback to the operator while the machine is running. The machine telemeters pressure distribution, relative velocity distribution between tool and mirror and total lateral frictional force (drag) on the tool (lap). By calibration, it is possible to feedback ablation rate and to do so repeatedly for each point on the mirror surface during polishing. The rates are integrated to estimate how the mirror profile is evolving; this is displayed and the load pattern changed appropriately. At the end of each run, not only is the optical figure compared to that desired, but the predicted change is compared to the observed change. The algorithm for determining ablation is then adjusted accordingly, so the system learns.

A second embodiment of the invention will now be described with reference to FIGS. 2 to 6. The tool (not shown) is attached to a flexible diaphragm 1 which is fixed to the tool-head 2. The tool-head rotates on bearings 3 about the fixed hollow shaft 4 and is driven through the metal bellows flexible coupling 5 which allows the tool to be loaded axially. The channel in the hollow shaft enables the air pressure behind the flexible diaphragm to be varied.

The flexible coupling 5 is connected to the rotating pulley wheel 7 by the knurled nut 6 which permits different sizes of tool-holders to be interchanged. The pulley wheel is mounted on the ball-bearing 8 and is driven by the toothed belt 9 from the smaller pulley wheel 10 which is in turn driven through the flexible shaft 11 from an independently mounted electric motor (not shown).

Figure 4:
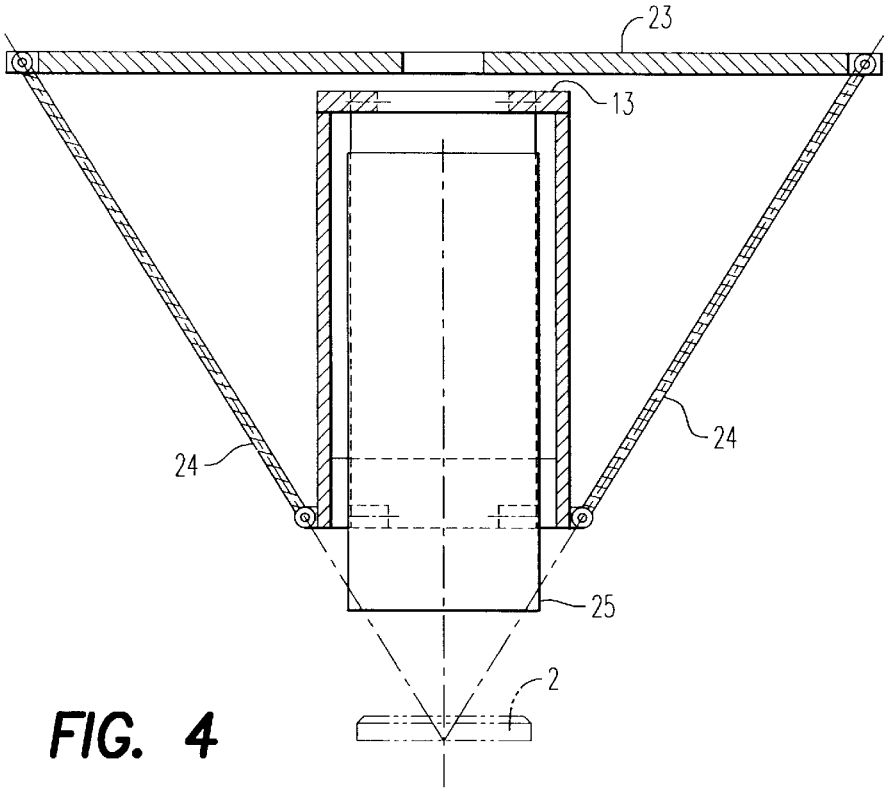
FIG. 4 is a schematic cross section along the line A to A of FIG. 3.
Figure 5:
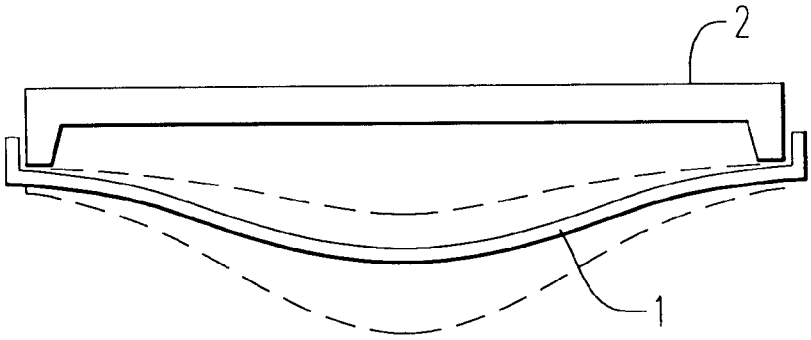
FIG. 5 is a schematic section corresponding to the view of FIG. 2, showing the working portion of the tool in different configuration.

The pulley drive assembly is mounted on the plate 12 which in turn is connected to an intermediate mounting plate 13 by two links 14 each hinged at one end to the plate 13 and at the other end to the plate 12. These links constrain the axis of plate 12, and hence the tool, to rock in the plane of the drawing about a virtual pivot point P close to the centre of the tool. This mechanical linkage is shown also in FIG. 3, which is diagrammatic only and not to scale. Additional links 24, shown in the orthogonal sectional view of FIG. 4, are provided so that there can be a similar movement in the orthogonal plane, with the relative movement of the tool constrained to pivotal rocking motion about the virtual pivot point P. The tilt is controlled by two double-acting hydraulic cylinders 15 (one only is shown) coupled to position transducers (not shown) so that the tool angle can be accurately set using positional information feedback to a control circuit.

The fixed hollow shaft 4 is connected to the loading rod 16 which is constrained to move axially, relative to a rigid housing 25 connected to the plate 12, by flexural supports 17. The axial force applied by the loading rod 16 to shaft 4, and hence the tool, is set by the solenoid 18 through the load cell 19 which measures this force. The actual force applied to the tool will differ from this because of the spring constants of the flexural supports 17 and the bellows coupling 5, both acting in the axial direction. The position transducer 20, which in this example is an LVDT (linear variable differential transformer), measures the axial movement of the loading rod and provides a signal from which the axial spring force can be determined, for correcting the load-cell reading.

The lateral force exerted on the tool by friction with the work piece is measured by strain gauges 21 mounted on the loading rod 16 which is locally thinned so that it bends in response to this force.

The flexible tube 22 is connected to the central channel in the loading rod 16 and feeds the air for pressurising the flexible diaphragm 1. The pressure is controlled as described below, and the air under pressure is supplied from a standard pump (not shown). It will however be appreciated that other fluids including liquids could be used.

In this second exemplification, variation in the contact area for polishing is performed by calculated compression of a soft tool under computer control. One effect of the method exemplified is that the polishing pressure is maintained approximately constant for a range of contact areas and total forces.

Figure 2:
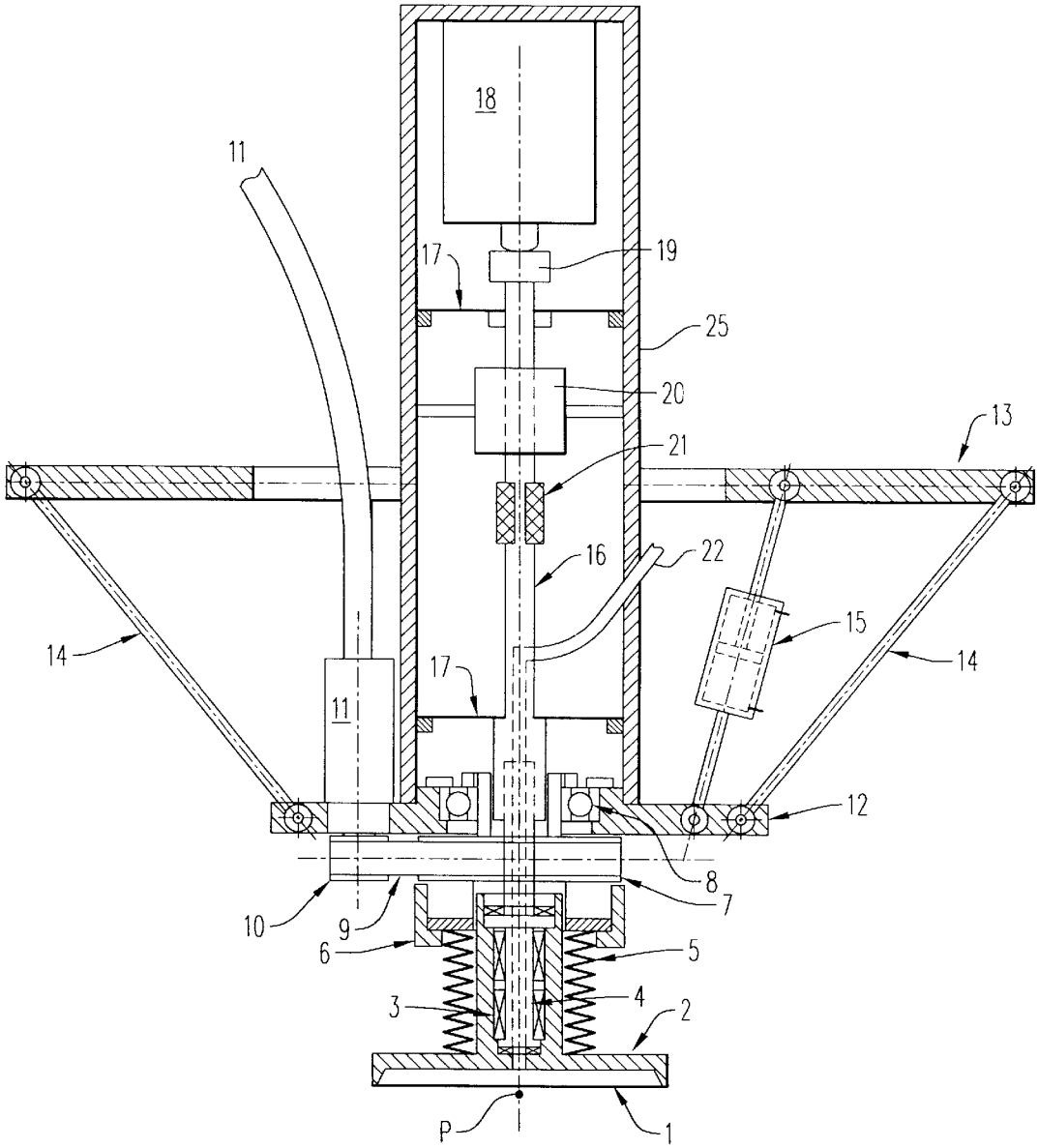
FIG. 2 is an axial section through a lapping tool in accordance with a further embodiment of the invention.
Figure 3:
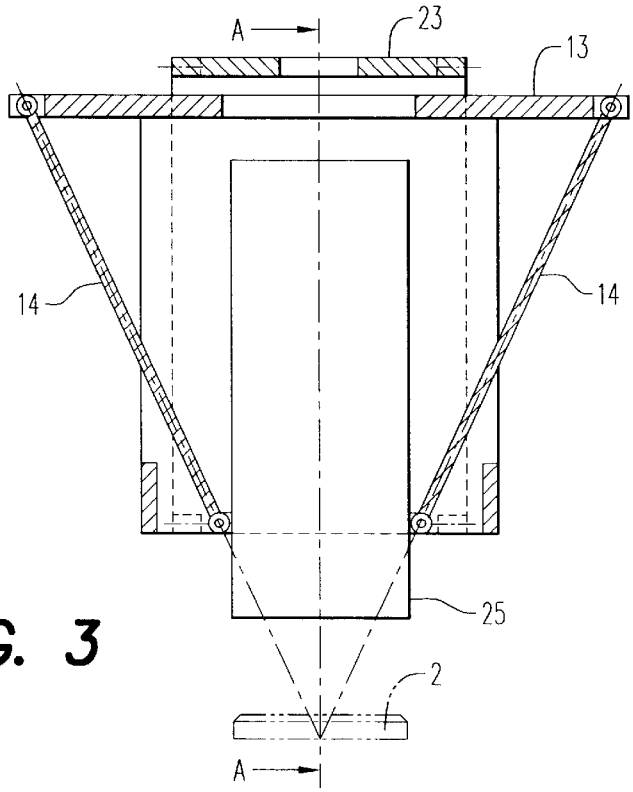
FIG. 3 is a schematic cross section, corresponding to the view of FIG. 2, of the embodiment of FIG. 2, identifying more clearly the support arrangement for the tool head.

In FIG. 2, the soft tool is shown as a rubber diaphragm inflatable by air. It is 50 mm in diameter and 2 mm thick for a workpiece of 250 mm diameter, or larger or smaller in proportion to the workpiece size, or for polishing larger or smaller areas. The diaphragm is inflated with computer-controlled pressure, or temporarily or permanently sealed, so as to bulge. The air pressure is a close approximation to the required polishing pressure. The bulge of the tool is covered on the work side with a polishing material. The polishing material can consist of, for example, cloth, felt, soft polyurethane foam or a mosaic of pitch segments on cloth and can be glued onto the diaphragm. The material can polish in the normal way with the addition of a fine abrasive. The tool is moved towards the workpiece by the machine under computer control, to positions ranging from first contact, then increasingly close so that the bulge is compressed giving increasing contact area. This sequence is illustrated very schematically in FIG. 5. When that occurs, the inflated space is compressed, but as its volume is reduced by less than 10 percent the air pressure increases by less than 10 percent. Therefore the polishing pressure as determined by the air pressure is constant to within 10 percent. When the required contact area is obtained in this wav the tool and workpiece are rotated or moved by computer-controlled motors in any way required for polishing.

The tool may be used in a different mode. In this case, the tool is pressurised or partially evacuated so that the diaphragm approximates to the mean radius of curvature (concave or convex) of the workpiece. The air pressure is then modified slightly to create a distributed PRESSURE exerted by all (or part of) the surface of the tool in contact with the workpiece. The pressure distribution is governed by both the air pressure and the tension in the rubber. By choosing an appropriate radial variation in the thickness of the rubber, a pressure distribution may be achieved, which tapers to zero at the edge of the contact area with the workpiece.

Figure 6:
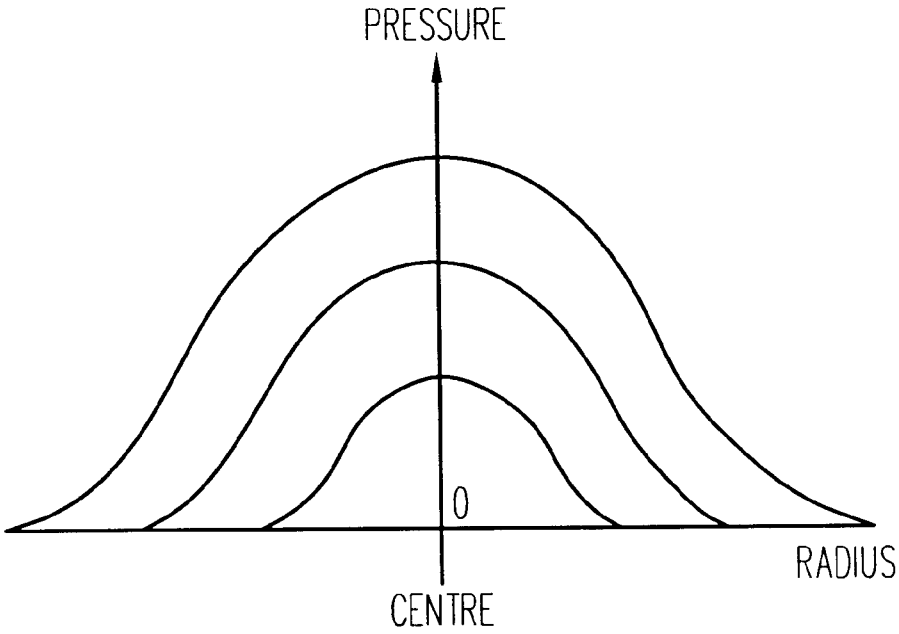
FIG. 6 is a graph showing the pressure profile of the flexible working surface of the tool of FIG. 5 in use, as a function of radius from the centre of the tool.

This is illustrated schematically in FIG. 6, showing the pressure profile with radius. Conversely, by decreasing the air pressure, an effect similar to a ring-lap may be achieved.

The machine carries the tool on three perpendicular motorised slides. They can change the position of the tool under computer control in relation to the workpiece as described. In addition, a faster change of position and force is provided by means of the solenoid actuator 18. Errors due to friction are reduced by using the flexures 17 rather than slides within the tool.

The total force (pressure times area) exerted towards the workpiece increases as the contact area increases. This total force is encoded by a load cell. The applied force as measured by the load cell can be compared with the force predictable from the position in order to validate the operation, as described above. Other load cells such as gauge 21 encode the polishing force in a direction parallel to the surface of the workpiece.

The rate of removal of glass (ablation) during polishing depends on several factors including the pressure, speed and lateral drag force of the tool. Force values are available to the computer from load cell readings. The position of the tool is determined by the three perpendicular motorised slides mentioned above, and by the position of the turntable supporting the workpiece, whose rotary position is also encoded. The speed of a spinning tool (if used) is estimated from the motor current or from a rotary encoder. The computer is therefore able to drive the tool at known velocities in relation to the workpiece.

Empirical physical laws are defined for a particular workpiece. According to these physical laws, the rate of ablation is proportional to the product of the pressure, speed and polishing time, or the drag force, speed and time. The constants of proportionality are estimated at the start of the work. To do this the rate of glass removal is measured using a conventional optical test before and after a period of work on part of the workpiece area. Having determined the physical law under current conditions, the computer can numerically integrate the instantaneous ablation rate and can therefore estimate a contour map of actual glass removal while working. It can use the estimated contour map to achieve a good approximation to the required result. The constants of proportionality can be redetermined in successive work cycles.

The time spent passing over high areas can be increased to ablate them preferentially, which is a well-known process for rotating tools.

WITH THE BENEFIT OF THE PRESENT INVENTION, the computer drive can position the tool over a high spot of the workpiece and adjust the contact area of the tool to match the high spot. Thus the high spot can be lowered by polishing without simultaneously reducing surrounding areas. Without the invention, erroneous work is done in areas close to or around high spots and can make the surface too low in those areas. Low areas are more difficult to remove than the original high spots—as glass cannot be added, low areas potentially lead to a need to repolish all the remaining surface.

Another method of measuring the force applied to the workpiece is to use load cell devices supporting the workpiece (rather than in the tool). The workpiece is normally on a conventional rotating turntable, and in that configuration the load cells can be between the turntable and the workpiece. They can rotate with the workpiece and can be connected electrically through an axial tubular shaft which drives the workpiece, with the aid of slip rings and/or optical free-space data transmission.

A variety of tools can be constructed for one machine and the maximum contact area of a tool will normally be less than one quarter of the area of the particular polished surface. The rubber diaphragm can also be manufactured so that it is set flat or curved under zero pressure. To produce a tapering-off of the applied pressure at the edge of the bulge contact area, increased thickness of diaphragm rubber can be used. Similarly the rubber may have non-uniform thickness.

A facility for spinning the tool around its axis is optionally included. It is operated when it is required to increase the polishing speed.

This second exemplification also includes a method of pointing the tool directly at the workpiece with the required angle of attack. Normally this angle is such that the axis of the tool is orthogonal to the polished surface at the central contact point. However, the option is included of non-orthogonal axes, in which case the polishing action occurs towards or at the edge of the tool. The method of controlling the tool angle is described as a virtual pivot, as described above in relation to FIGS. 2 to 4. It consists of hinged plates or rods arranged and actuated to tilt the rest of the tool assembly approximately around the centre of the tool contact area. The advantage of this virtual pivot is that the angle of attack can be changed without swinging the tool across the workpiece, as would occur if the pivot point were distant from the tool. Furthermore, there is little or no reaction of the frictional drag of the polishing tool against the actuators which change the angle of attack, thereby minimising the actuator force requirements.

Although the invention has been illustrated by two principal machines for optical polishing, other embodiments of the invention, as defined in the attached claims, are possible. Many other ways of varying the contact area and pressure profile of polishing tools could be employed, not limited to the hydraulic, pneumatic or spring-mechanical examples given.

What is claimed is:

1. A method of optically polishing a surface of a workpiece, the method comprising:

positioning a tool having a mount onto which is mounted a flexible working surface substantially smaller than the surface of said workpiece relative to said surface of said workpiece such that there is an area of contact between said flexible working surface and said surface of said workpiece and said mount is spaced from said surface of said workpiece; and automatically controlling the separation of said mount and said surface of said workpiece so as to control the size of said area of contact.

2. A method according to claim 1, wherein pressure applied to said surface of said workpiece by said flexible working surface tapers from a maximum value in a central region of said area of contact to zero at the periphery thereof.

3. A method according to claim 1, wherein pressure applied to said surface of said workpiece by said flexible working surface has a peak value and decreases progressively towards the periphery of said area of contact.

4. A method according to claim 1, wherein pressure applied to said surface of said workpiece by said flexible working surface is in the form of a truncated Gaussian with a maximum at the centre of said area of contact.

5. A method according to claim 1, including applying a central force on a central portion of said flexible working surface to provide a central enhancement of pressure applied to said surface of said workpiece.

6. A method according to claim 5, including applying forces around said central portion oat a region of said flexible working surface spaced transversely from said central portion to provide said central enhancement of pressure applied to said surface of said workpiece.

7. A method according to claim 1, wherein said mount comprises a rigid support forming a fluid chamber, and said flexible working surface comprises a diaphragm supported by said rigid support, the method including controlling the pressure in the fluid chamber to control the pressure applied to said surface of said workpiece over said area of contact.

8. A method according to claim 7, wherein said diaphragm is selected to have a thickness which varies over its area so as to provide a required pressure distribution.

9. A method according to claim 1, including rotating said tool about an axis to provide a rotary polishing action.

10. A method according to claim 1, including controlling the angle of attack of said tool against said surface of said workpiece using a principle actuator and controlling the position of said tool using three further actuators.

11. A method according to claim 10, wherein said tool is held in a body by a pivoted linkage, and the tool angle of attack is controlled so as to pivot the tool about a virtual pivot located at said surface of said workpiece.

12. A method according to claim 1, including determining a path to be traveled across said workpiece, predicting said area of contact and pressure to be applied over said area of contact and pressure to be applied over said area of contact at positions in the path to achieve the desired polishing, and moving said tool along said path whilst dynamically controlling said pressure and area of contact in accordance with the prediction.

13. A method of production of an optical component including optically polishing a surface of said optical component using the method of claim 1.

14. A method of production of an optical component including optically polishing a surface of said optical component using the method of claim 12.

15. A method of production of a mirror including optical polishing a surface of the mirror using the method of claim 1.

16. A method of production of a mirror including optical polishing a surface of the mirror using the method of claim 12.

17. Optical polishing apparatus constructed for the optical polishing of a workpiece surface of a predetermined maximum area, the apparatus comprising:

a holder for holding the workpiece having said workpiece surface of predetermined maximum size;

a tool comprising a flexible working surface having an area substantially smaller than said predetermined maximum area and a mount onto which said flexible working surface is mounted;

actuator means for moving said tool relative to said surface of said workpiece to form an area of contact between said flexible working surface and said surface of said workpiece and to space said mount from said surface; and control means for automatically controlling said actuator means to control the separation of said mount and said surface of said workpiece to control the size of said area of contact.

18. Apparatus according to claim 17, wherein said tool is adapted to use said flexible working surface to apply a pressure to said surface of said workpiece which tapers from a maximum value in a central region of said area of contact near or at the periphery thereof.

19. Apparatus according to claim 17, wherein said tool is adapted to use said flexible working surface to apply a pressure to said surface of said workpiece which has a peak value and decreases progressively towards the periphery of said area of contact.

20. Apparatus according to claim 17, wherein said tool is adapted to use said flexible working surface to apply a pressure to said surface of said workpiece which is in the form of a truncated Gaussian with a maximum at the centre of said area of contact.

21. Apparatus according to claim 17, wherein said tool includes a central actuator for applying a central force on a central portion of said flexible working surface to provide a central enhancement of pressure applied to said surface of said workpiece.

22. Apparatus according to claim 21, wherein said tool includes at least one further actuator for applying forces around said central portion at a region of said flexible working surface spaced transversely from said central portion to provide said central enhancement of pressure applied to said surface of said workpiece.

23. Apparatus according to claim 17, wherein said mount comprises a rigid support forming a fluid chamber, said flexible working surface comprises a diaphragm supported by said rigid support, and said control means is adapted to control the pressure in the fluid chamber to control the pressure applied to said surface of said workpiece over said area of contact.

24. Apparatus according to claim 23, wherein said diaphragm is selected to have a thickness which varies over its area so as to provide a required pressure distribution.

25. Apparatus according to claim 17, including means for rotating said tool about an axis to provide a rotary polishing action.

26. Apparatus according to claim 17, including an angle of attack actuator means controllable to control the angle of attack of said tool against said surface of said workpiece and two further actuator means controllable to control the position of said tool in a plane perpendicular to the direction of operation of said actuator means.

27. Apparatus according to claim 26, wherein said tool is held in a body by a pivoted linkage to allow said tool to pivot about a virtual pivot located at said surface of said workpiece.

28. Apparatus according to claim 17, wherein said control means is adapted to determine a path to be traveled across said workpiece, to predict said area of contact and pressure to be applied over said area of contact at positions in the path to achieve the desired polishing and to control the movement of said tool along said path whilst dynamically controlling said pressure and said area of contact in accordance with the prediction.

* * * * *